United States Patent [19]

Dunn et al.

[11] 4,413,733

[45] Nov. 8, 1983

[54] PIPE NESTING DEVICE

[75] Inventors: J. James Dunn, Brookwood; Robert M. Graham, Birmingham, both of Ala.

[73] Assignee: U.S. Pipe and Foundry Company, Birmingham, Ala.

[21] Appl. No.: 374,573

[22] Filed: May 3, 1982

[51] Int. Cl.[3] ..... B65D 85/20; F16L 3/22

[52] U.S. Cl. ..... 206/446; 138/113; 138/114; 248/49; 248/68 R; 403/12; 410/32; 410/47; 414/745; 414/910; 206/443

[58] Field of Search ..... 206/443, 499, 446, 514; 138/113, 114, 108, 109; 403/12; 410/32, 47; 248/68 R, 49, 56, 57; 224/42.15, 42.19, 42.26, 42.27; 414/745, 910

[56] References Cited

U.S. PATENT DOCUMENTS

| | | | |
|---|---|---|---|
| 1,477,818 | 12/1923 | Gerlat | 206/443 |
| 1,837,169 | 12/1931 | Mazurie | 206/446 |
| 2,059,390 | 11/1936 | Pagel | 206/499 X |
| 2,076,210 | 4/1937 | Stadtfeld | 138/113 |
| 2,423,986 | 7/1947 | Lathrope | 206/446 X |
| 3,349,168 | 10/1967 | Rehder et al. | 138/108 |
| 4,250,927 | 2/1981 | Newburg | 138/113 |
| 4,250,928 | 2/1981 | Nishikawa | 138/113 |
| 4,253,792 | 3/1981 | Nishikawa | 206/443 X |

*Primary Examiner*—Steven M. Pollard
*Assistant Examiner*—Bryon Gehman
*Attorney, Agent, or Firm*—James W. Grace; Charles W. Vanecek

[57] ABSTRACT

A device for holding nested bell and plain end push on joint pipes in a fixed position utilizing a novel frame work of simple members fastened firmly together. The inner pipe may be held concentrically or eccentrically with respect to the outer pipe.

Padding may be added to protect inside coatings, and safety strapping offers added security that allows an abrasion resistant sheet to be held in place until disassembly occurs.

7 Claims, 3 Drawing Figures

PIPE NESTING DEVICE

BACKGROUND OF THE INVENTION

For many years pipes have been loaded onto transport means either individually or placed side by side in rows, stacked row upon row and banded together. The banded group is handled as a unit load onto the transport means. In some instances light weight pipes have been nested; i.e., placed one inside the other and bulkheads were built at each end of the nest to prevent axial movement. This method becomes very difficult when heavy iron pipes are involved. U.S. Pat. No. 4,250,928 addresses the problem and provides specially formed shaped for concentrically nesting pipes wherein the pipes to be nested are of suitable diameter.

The main object of the invention in U.S. Pat. No. 4,250,928 is to provide a device for holding pipes to one another each at one end when they are nested with a small difference in diameter from one another such that the sockets of the pipes are positioned close to one another or diametrically interfere with one another, whereby the nested pipes can be effectively restrained against diametrical or axial displacement from one another although the device is small-sized and easy to attach. However, only pipes which have small differences in diameters can be accommodated.

Another device for nesting pipes of varying diameters is shown in U.S. Pat. No. 4,253,792 which illustrates a complex structure of a base having multiple bars extending outwardly from the base to receive the ends of the nested pipes.

However, when the pipes to be transported may vary widely in diameter, a device such as that herein described has been found to be a distinct improvement of the prior art. The improved device allows either concentric or eccentric nesting of pipes and does not require the bending or welding of any material. All components can be cut from readily available standard products and simply bolted together. The nest is made regardless of the difference in diameter between nested pipes so long as one will physically fit inside the other.

SUMMARY OF THE INVENTION

A gasket retainer groove is a structural portion of push-on joint pipes and provides an excellent means of anchoring restraining members inside the bell opening. A device comprising a frame work of members anchored inside the outer pipe bell presents an excellent structure to which an inner pipe is anchored, utilizing its gasket retainer groove to retain restraining members. The members employed are so shaped and arranged that the inner bell may be located concentrically within the outer pipe bell or may be located at a predetermined eccentric position. The invention also allows the placing of support material between the bells of nested pipes to prevent abrasion during handling and extended transport. Such abrasion protection is especially important when overseas shipment of pipes is required. Such shipment subjects the nested pipes to many days of continuous movement and necessitates loading and unloading numerous times before the pipes are finally put to use. Damage to linings and/or coatings of the invert of the outer pipe. This material, preferably a thin polyethylene sheet, provides an abrasion resistant ramp along which the inner pipe may be slid to unnest.

OBJECTS OF THE INVENTION

It is an object of the invention to provide a novel device for fixedly holding nested pipes against mutual movement while conserving space for the transport of the pipes.

It is another object of the invention to provide a novel device for fixedly holding nested pipes in place in which the novel device is made of conventionally available parts and is easily prepared and assembled.

It is yet another object of the invention to provide a novel device for fixedly holding nested pipes in place while protecting the linings of the pipes against abrasion.

It is a further object of the invention to provide a novel device for holding nested pipes in place while yet permitting easy disassembly of the nest of such pipes.

Other objects and advantages of the present invention will become apparent to those skilled in the art from a consideration of the attached drawing in which like numerals indicate like elements and in which.

DESCRIPTION OF THE PREFERRED EMBODIMENT

Figure 1:
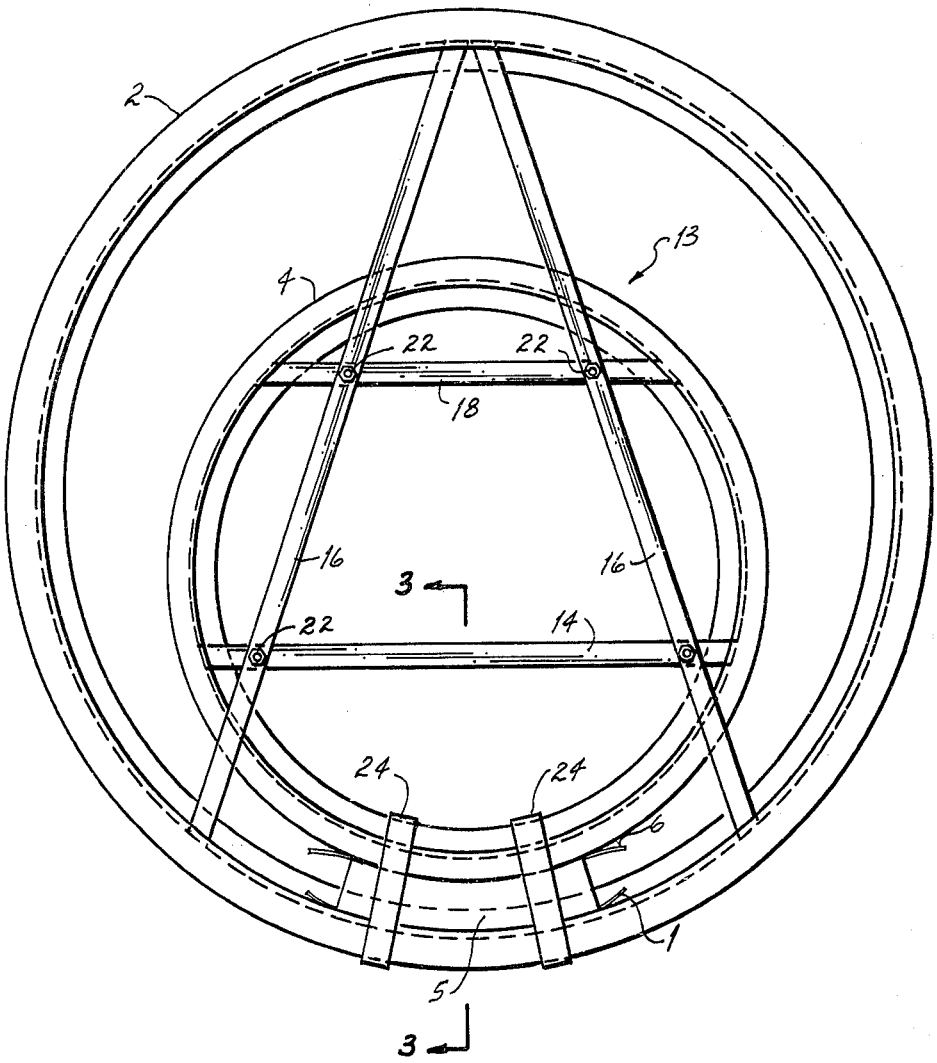
FIG. 1 is an elevational view from the bell end showing two nested pipes.
Figure 2:
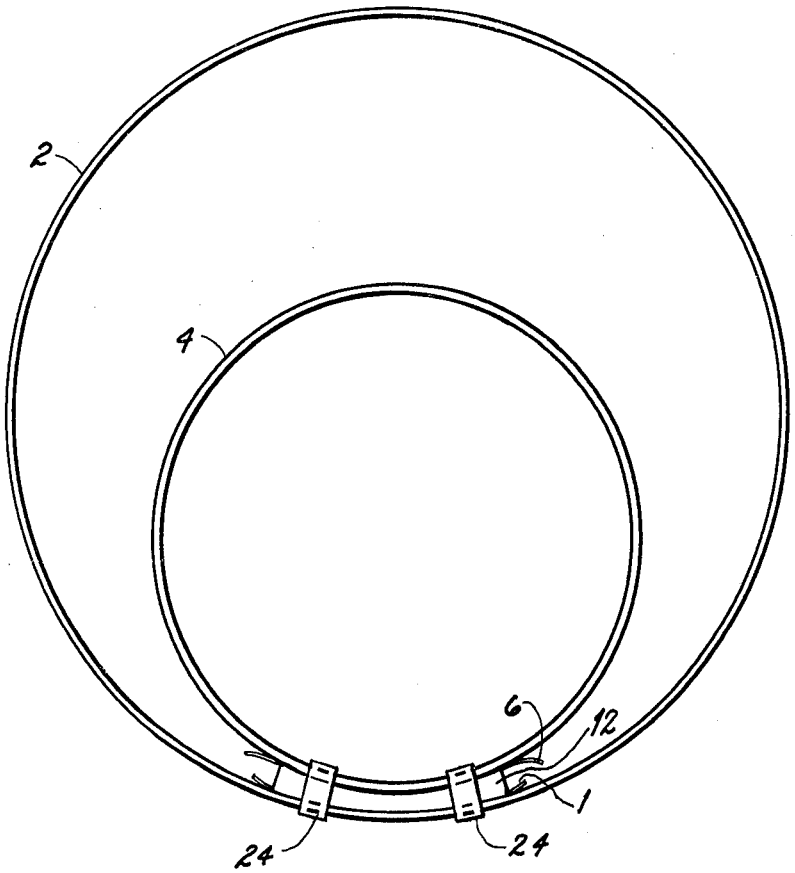
FIG. 2 is an elevational view from the plain end of two nested pipes with the bells not shown.
Figure 3:
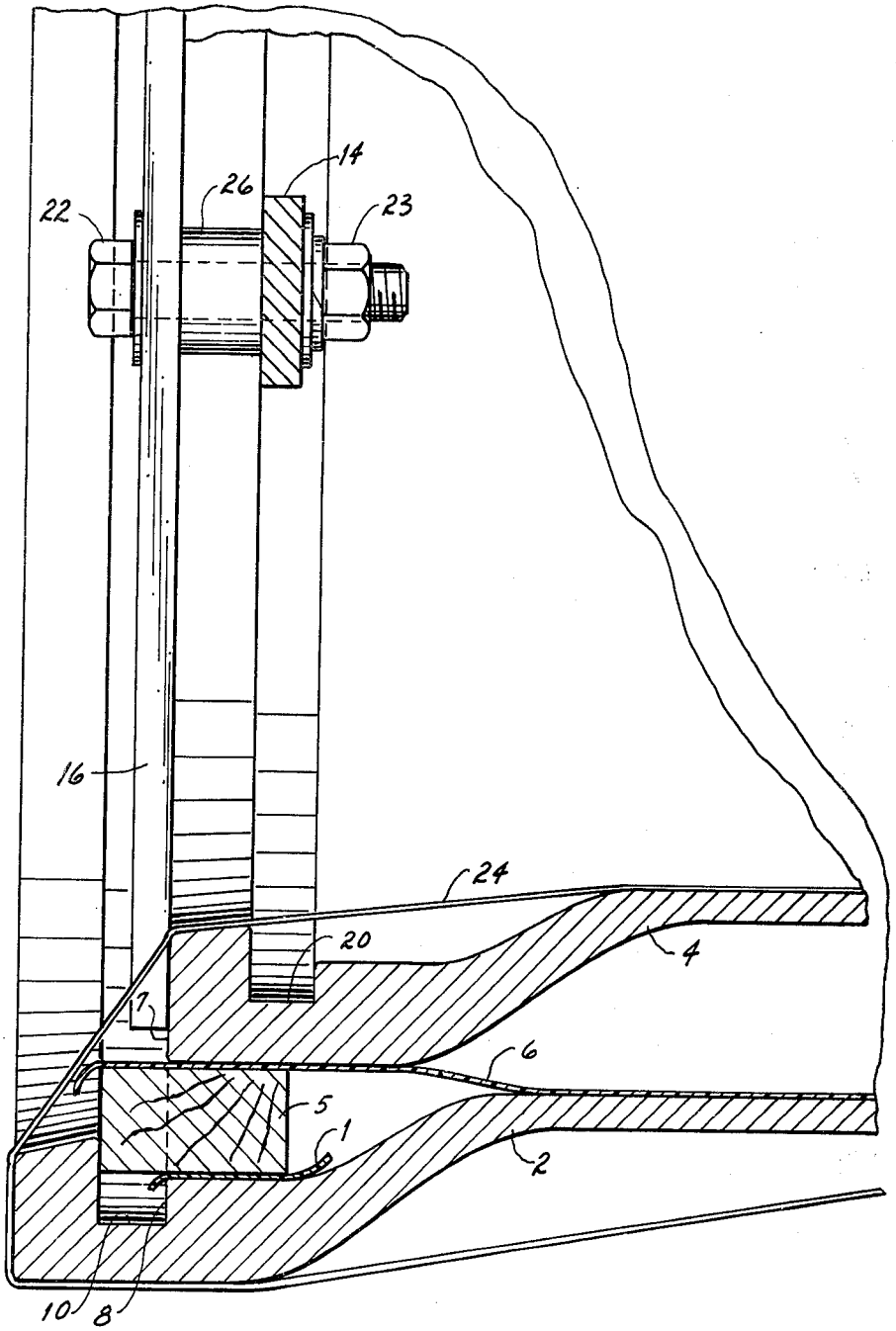
FIG. 3 is a fragmentary sectional view along lines A—A of FIG. 1.

In the preferred embodiment, as best seen in FIG. 1, there are 2 pipes, one of which is to be nested inside the other in a fixed position relative to each other. Outer pipe 2 is of greater diameter than inner pipe 4. A thin sheet 1 of abrasion resistant material such as polyethylene is placed in the invert of the larger pipe 2. A block 5 is placed in the bell invert of pipe 2 and covered with a sheet 6 of abrasion resistant material, such as polyethylene. Sheet 6 covers the full length of the invert of outer pipe 2. Block 5 is preferably of wood but rubber or such like material would be suitable. The smaller pipe 4 is then placed inside the larger pipe 2. Placing one pipe within the other may be accomplished by means of a fork truck or the like in the manner described in U.S. Pat. No. 4,253,792. As may be seen in FIG. 3, bell face 7 of inner pipe 4 is aligned with the inner edge 8 of retainer groove 10 in the bell end of pipe 2, and the outside of the bell of pipe 4 is allowed to rest on block 5 which is protected by sheet 6. Also, as shown in FIG. 2, a pad 12 made of rubber belting, insulating board or other abrasion resistant resilient material is placed between the outside of pipe 4 and the invert of pipe 2 at the plain end of the pipes. Sheet 6 covers the upper surface of pad 12. Pad 12 which is preferably about twelve inches square should be placed on top of thin polyethylene sheet 1. With the pipe in this position, the device 13 for holding the pipes in fixed position is then connected at the bell end of the pipes. Device 13 comprising frame members 14, 16 and 18 is bolted into place with bolts and nuts 22 and 23, respectively, with the ends of members 16 extending into retainer groove 10 of pipe 2 and the ends of members 14 and 18 extending into retainer groove 20 of pipe 4.

Members 14, 16 and 18 may be flat steel stock bars having a thickness less than the width of retainer grooves 10 and 20 and lengths sufficient to span from a groove on one side of a respective pipe to the corresponding groove on the other side of the respective pipe. The width of members 14, 16 and 18 need only be enough to accommodate bolts 22. Obviously, wide latitude is given to the selection of the dimensions of the members 14, 16 and 18 to accommodate pipes of widely differing diameters and groove widths. In order to prevent bending of the frame members when bolts 22 are tightened, pipe sleeves or spacers 26 are placed around bolts 22 and between the frame members being joined. Washers and lock washers are also preferred to allow a reliable bolted connection which will resist loosening. As may be seen in FIG. 3, members 16 are coplanar as are members 14 and 18 with the respective planes being spaced a predetermined distance from each other by spacers 26. To insure that pad 12 and thin sheet 1 remain in place regardless of the orientation of the nested pipes, one or more banding straps 24 are placed through pipe 4 at its invert and around the outside of pipe 2 thus banding the two pipes together as shown in the drawings.

While the pipe nesting device of the present invention has been illustrated and disclosed with respect to the nesting of 2 pipes, it is clear that the same concept can be expanded to cover a pipe nesting device which is capable of securing three or more pipes in a nested configuration. For three pipes, additional elongated members need only be connected to the frame 13 and engage the retainer groove in the third pipe. Likewise, four or more nested pipes can be accommodated.

Whereas the present invention has been described with respect to specific embodiments thereof, it should be understood that the invention is not limited thereto as many modifications thereof may be made. It is, therefore, contemplated to cover by the present application any and all such modifications as fall within the true spirit and scope of the appended claims.

We claim:

1. A device for fixedly holding a first push-on joint bell and plain end pipe having a retainer groove in its bell end within a second push-on joint bell and plain end pipe of greater diameter, said second pipe having a retainer groove in its bell end, said first pipe being placed so that the outer face of its bell end is in substantial alignment with the inner edge of said groove of said second pipe, comprising a frame having at least two first elongated members adapted to engage said groove in said second pipe, said frame further having at least two second elongated members spaced from said first elongated members and extending outwardly from said first elongated members, said second elongated members being adapted to engage said groove in said first pipe, said first and second elongated members being fastened together in a fixed relationship.

2. A device as recited in claim 1 in which said first and second pipes are separated by force absorbing media.

3. A device as recited in claim 1 in which said first and second elongated members are fastened together in a fixed spaced relationship so that the plane of said first elongated members is aligned with the groove of said second pipe and the plane of said second elongated members is aligned with the groove of said first pipe.

4. A device as recited in claim 3 in which said first and second elongated members are spaced from each other by a spacer whose length is approximately equal to the distance between the grooves of said first and second pipes.

5. A device as recited in claim 1 in which said first and second pipes are further bound by at least one band extending along the invert of said first pipe and around the outside of said second pipe and fixed in a tightened condition.

6. A nest of push-on bell and plain end pipes having a retainer groove in the bell of each pipe comprising:

(a) a first and second pipe, (b) said first pipe being placed inside said second pipe with said bell of said first pipe being displaced substantially axially from said bell of said second pipe, (c) a first structural member extending across a chord of said bell of said second pipe and having each end of said first structural member extending into said retainer groove of said second pipe, (d) a second structural member coplanar with said first structural member, said second structural member extending across a diametrically opposite chord of said bell of said second pipe and having each end of said second structural member extending into said retainer groove of said second pipe, (e) a third structural member extending across said first and second structural members and across a chord of the bell of the first pipe and having each end of said third structural member extending into said retainer groove of said first pipe, (f) a fourth structural member coplanar with said third structural member, said fourth structural member extending across said first and second structural member and across a diametrically opposite chord of said bell of said first pipe and having each end of said fourth structural member extending into said retainer groove of said first pipe, and (g) said first structural member being bolted to said third and fourth structural members and said second structural member being bolted to said third and fourth structural members.

7. The invention of claim 6 wherein an abrasion resistant sheet is placed between said first pipe and said second pipe, a block of abrasion resistant resilient material is placed inside the bell of said second pipe and under the outside of the bell of said first pipe and at least one metal band is extended along the invert of said first pipe and around the adjacent outside said second pipe and fixed in a tightened position.

* * * * *